US005931060A

United States Patent [19]

Brown

[11] Patent Number: 5,931,060

[45] Date of Patent: Aug. 3, 1999

[54] COLLAR ATTACHMENT FOR A VERTICALLY SUSPENDED SCREW DRIVE

[76] Inventor: Marlin L. Brown, 55214 Caldwell Dr., Osceola, Ind. 46561

[21] Appl. No.: 08/888,216

[22] Filed: Jul. 3, 1997

[51] Int. Cl.[6] ..... B25B 13/00

[52] U.S. Cl. ..... 81/54; 81/180.1; 81/177.1

[58] Field of Search ..... 81/54, 57.24, 57.4, 81/180.1, 177.1

[56] References Cited

U.S. PATENT DOCUMENTS

| | | | |
|---|---|---|---|
| 2,064,740 | 3/1936 | Brandt | 81/57.4 X |
| 3,320,835 | 5/1967 | Flory et al. | 81/54 |
| 4,523,498 | 6/1985 | Chapman | 81/177.1 |

*Primary Examiner*—James G. Smith
*Attorney, Agent, or Firm*—R. Tracy Crump

[57] ABSTRACT

A collar attachment, which allows vertically suspended automatic screw drives to be operated more ergonomically is disclosed. The collar attachment eliminates the need for the operator to firmly grasp the screw drive in order to draw the screw drive down on a screw, thereby reducing hand and forearm fatigue. The collar attachment provides a horizontal annular platform extending radially from the screw drive upon which an operator's hand can rest naturally. With the operator's hand only loosely wrapped around the casing and rested upon the collar attachment, the operator can apply downward force to the collar attachment to draw the screw drive downward without firmly grasping the drive casing. The collar attachment includes two planar semi-circular half sections, which clamp radially around the cylindrical casing of the screw drive. The half sections are connected together around the screw drive by two bolts, which pass through parallel bores in one section and turn into aligned threaded bores in the other section.

4 Claims, 4 Drawing Sheets

COLLAR ATTACHMENT FOR A VERTICALLY SUSPENDED SCREW DRIVE

This invention relates to a collar attachment that improves the ergonomics of vertically suspended screw drives, and in particular, a collar attachment that reduces hand and arm fatigue caused by the operator firmly grasping the screw drive during repetitive use.

BACKGROUND OF THE INVENTION

Automatic screw drives are well known in the manufacturing field. Typically, conventional automatic screw drives are suspended vertically above the assembly area by a suspension cable or an articulated arm, which conveniently positions the drives without occupying other valuable work space. Most automatic screw drives designed to be vertically suspended have elongated cylindrical outer casings and incorporated an internal clutch mechanism, which activates when the operator draws the drive down on a screw. The downward force applied to the drive onto the screw by the operator engages the internal clutch and activates the drive to turn the screw down. Operators have to firmly grasp the cylindrical bodies of conventional screw drives in order to apply sufficient downward force to activate the driver and turn the screw down. Significant grip strength is required to grasp the cylindrical body of a drive while drawing the drives down on the screws. In addition, the ergonomics of pulling the vertically suspended cylindrical casing downward places significant stress on the operator's wrist in drawing the drives down on the screws. In a typical assembly line setting, operators frequently suffer from repetitive activity injuries as well as hand, wrist and forearm fatigue, which is caused by repeatedly grasping the cylindrical casing and pulling the suspended screw drives down onto the screws.

SUMMARY OF THE INVENTION

The collar attachment of this invention allows vertically suspended screw drives to be operated more ergonomically. The collar attachment eliminates the need for the operator to firmly grasp the screw drive's cylindrical body in order to draw the screw drive down on a screw, thereby reducing hand and forearm fatigue. The collar attachment provides a horizontal annular platform extending radially from the screw drive upon which an operator's hand can rest naturally. With the operator's hand only loosely wrapped around the screw drive and rested upon the collar attachment, the operator can apply downward force to the collar attachment to draw the screw drive downward without firmly grasping the elongated cylindrical screw drive.

The collar attachment includes two planar semi-circular half sections, which clamp radially around the cylindrical casing of the screw drive. The half sections are connected together around the screw drive by two bolts, which pass through parallel bores in one section and turn into aligned threaded bores in the other section. Each half section includes two flat parallel faces, a convex outer side edge and a concave inner side edge centered along the length of a straight diametrical side edge. When the half sections are connected, the concave inner side edges form a concentric circular opening for receiving the screw drive. The radius of the central opening approximates the outer diameter of the screw drive's cylindrical outer casing to provide a tight fit when the collar attachment is clamped to the screw drive. Although shown in the figures as having a disc-shaped configuration, the collar attachment of this invention may take any suitable shape or configuration to fit the suspended screw drive to which it will be connected.

Accordingly, an advantage of this invention is that the collar attachment allows vertically suspended screw drives to be operated more ergonomically.

Another advantage of the collar attachment of this invention is that it eliminates the need for the operator to firmly grasp the screw drive's cylindrical casing in order to draw the screw drive down on a screw, thereby reducing hand and forearm fatigue.

Another advantage of this invention is that the collar attachment provides a horizontal platform upon which an operator's hand can rest naturally while manipulating the screw drive.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to best explain the invention so that others skilled in the art might utilize its teachings.

Figure 1:
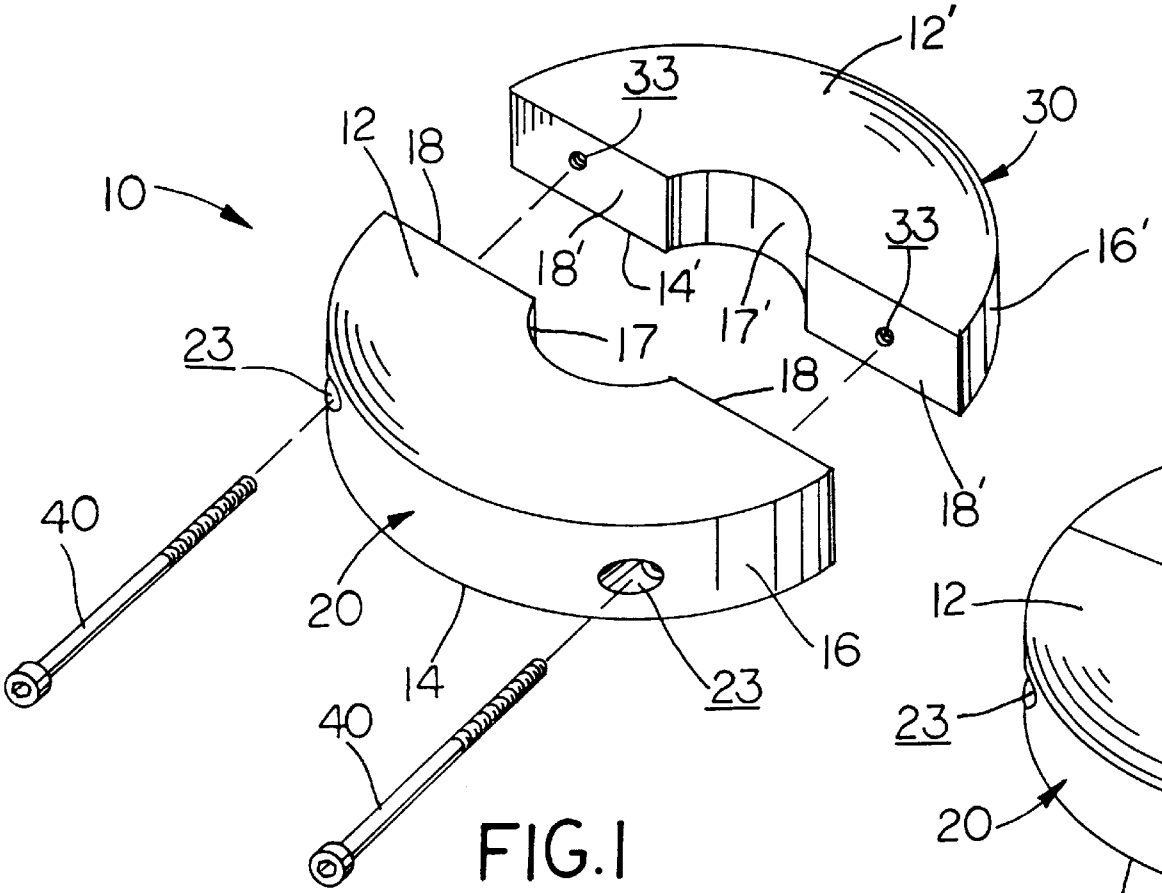
FIG. 1 is an exploded view of the collar attachment of this invention.
Figure 2:
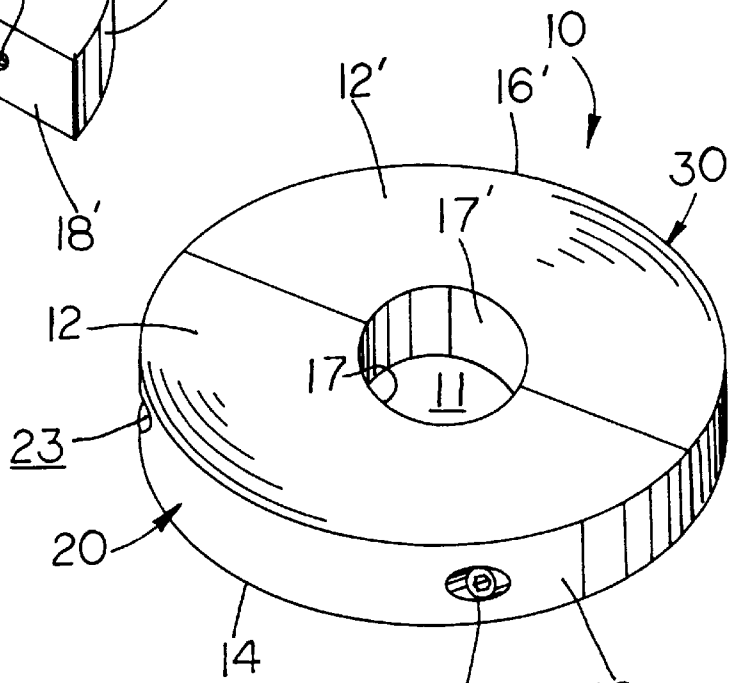
FIG. 2 is a perspective view of the collar attachment of this invention.
Figure 3:
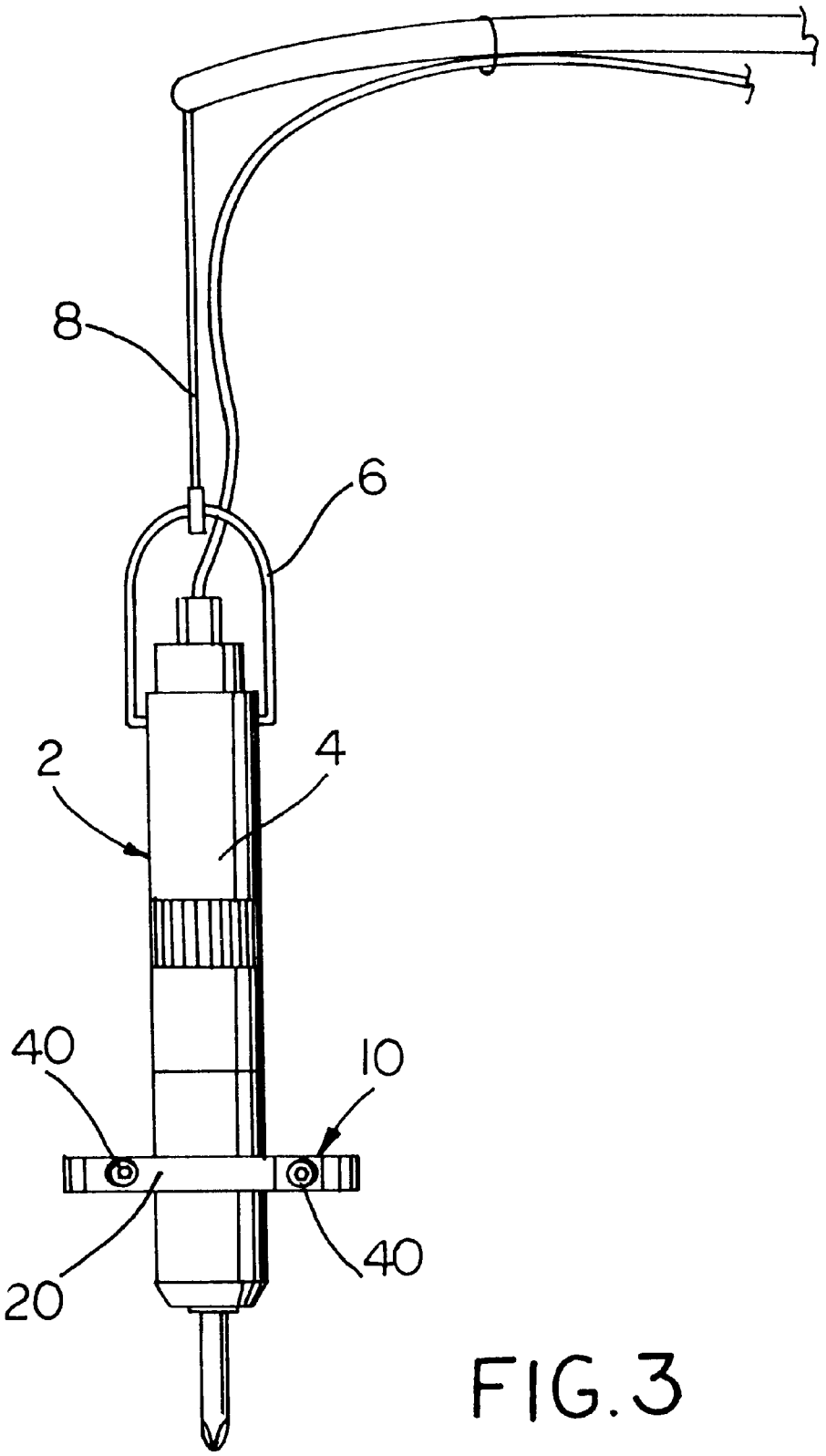
FIG. 3 is a side view of a screw drive with the collar attachment of this invention.
Figure 4:
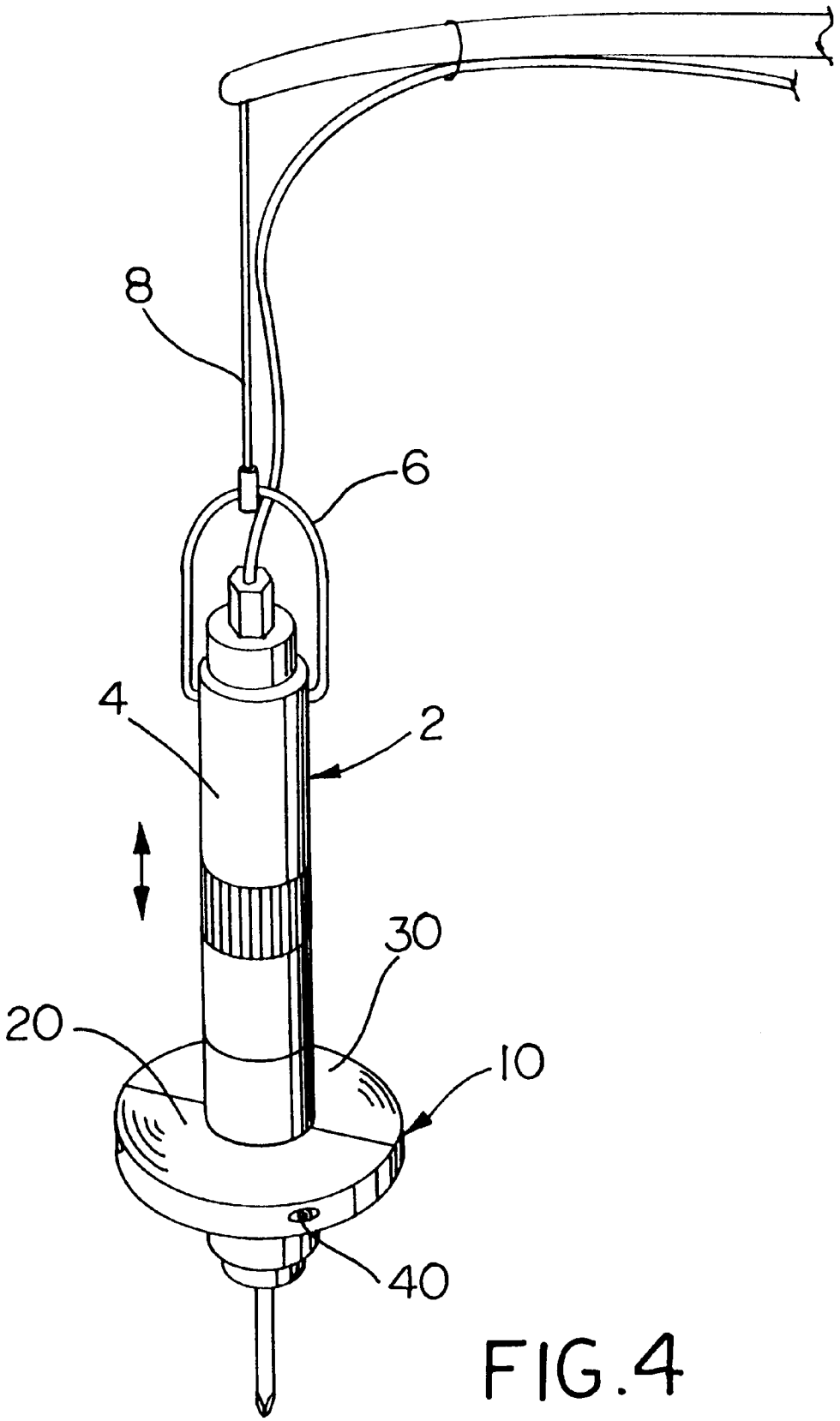
FIG. 4 is a perspective view of a screw drive with the collar attachment of this invention.
Figure 5:
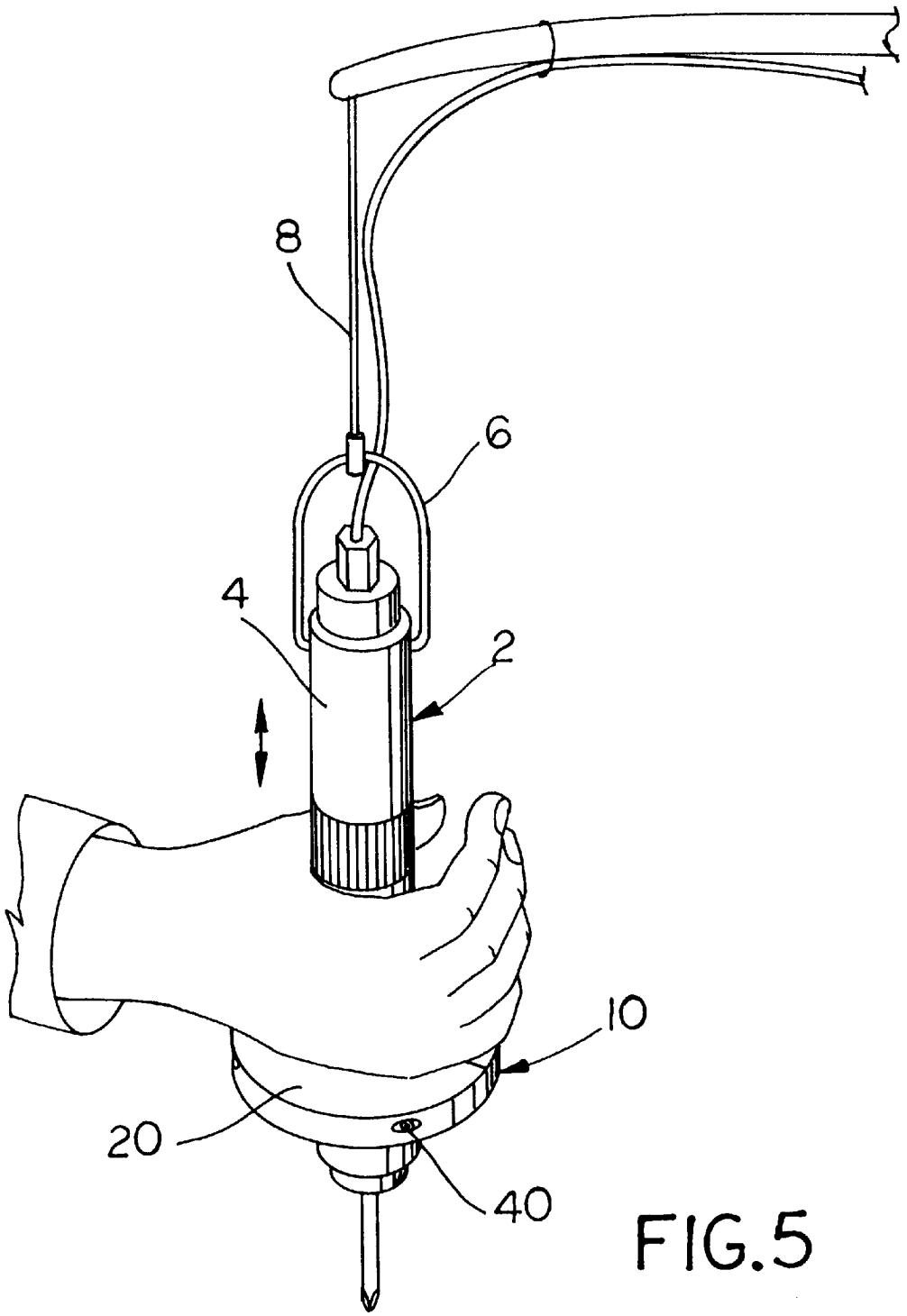
FIG. 5 is a perspective view of a screw drive with the collar attachment of this invention showing the hand of an operator atop the collar attachment.

FIGS. 1 and 2 show the collar attachment 10 of this invention. FIGS. 3–5 show collar attachment 10 connected to a conventional suspended screw drive 2, such as the model US-LT40B series pneumatic screw drives manufactured by Uryu Seisanu, Ltd. of Osaka Japan. As shown in FIGS. 3–5, screw drive 2 has an elongated cylindrical body or casing 4 and is suspended from its distal end by a suspension ring 6, which can be attached to a suspension cable 8 (shown in FIGS. 3–5) or articulated arm (not shown). Collar attachment 10 is intended to be used with any conventional suspended screw drive, which has an elongated drive casing.

As shown in the Figures, collar attachment 10 includes two planar semi-circular half sections 20, 30, which clamp around screw drive 2 to form an annular platform extended radially from drive casing 4. Halves 20 and 30 are constructed of any suitable material, including, but not limited to, plastic, wood, metal, or ceramic. Each half section 20 and 30 includes two flat parallel faces 12, 14 (top and bottom respectively), a convex outer side edge 16 and a concave inner side edge 17 centered along the length of a straight diametrical side edge 18. Half sections 20, 30 are connected together around the screw drive 2 by two bolts 40, which pass through parallel bores 23 in half 20 and turn into aligned threaded bores 33 in half 30. As shown in FIG. 2, concave side edge 17 forms a concentric circular opening 11 for receiving screw drive casing 4 when sections 20 and 30 are connected together. The diameter of opening 11 approximates the outer diameter of drive casing 4 to provide a tight fit when collar attachment 10 is clamped to screw drive 2. Although shown in the figures as having a disc-shaped configuration, the collar attachment of this invention may take any suitable shape or configuration to fit the suspended screw drive to which it will be connected.

As shown, collar attachment 10 is connected to screw drive 2 near the proximal end of drive casing 4. Collar attachment 10 provides a horizontal annular platform extending radially from drive casing 4 upon which the operator's hand rests. The location of collar attachment 10 near the proximal end of drive casing 4 positions the operator's hand wrapped around the center of screw drive 2 as usual, while resting atop the collar attachment. With the operator's hand and fingers only loosely wrapped around screw drive 2 and rested upon collar attachment 10, the operator can apply downward force to the collar attachment to draw screw drive 2 downward onto a screw without firmly grasping screw drive 2. Collar attachment 10 directly transfers the downward force applied by the operator to screw drive 2. Consequently, collar attachment 10 allows an operator to manipulate screw drive 2 with only minimal gripping force, if any at all, exerted to grasp the screw drive itself. Collar attachment 10 also allows the weight of the operator's hand and arm to directly contribute to the downward force necessary to engage the clutch mechanism and turn a screw down.

It is understood that the above description does not limit the invention to the details given, but may be modified within the scope of the following claims.

I claim:

1. In a vertically suspended screw drive used to turn down fasteners and comprising an elongated body, and a means for vertically suspending, an improvement comprising:

a collar attachment securing mountable to said drive for eliminating the need for an operator to firmly grasp said screw drive in order to draw said screw drive down on a screw, thereby reducing operator hand and forearm fatigue and improving the ergonomic operation of said screw drive, said collar attachment including a first and second planar section, and fastening means for mounting said first and second sections together around said body, said first and second planar section constituting means for forming a solid planar annular platform extending radially from said screw drive around diameter and perpendicular to the axis of said screw drive for safely and comfortably supporting an operator's hand in any orientation around said screw drive while manually operating said screw drive when said collar is mounted to said screw drive.

2. The collar attachment of claim 1 wherein each of said first and second planar sections has a flat semi-circular configuration formed by a convex outer edge and a straight diametrical edge being planarly opposed to said convex outer edge.

3. The collar attachment of claim 2, wherein each of said first and second sections having a concave inner edge formed along the length of said diametrical edge, said concave inner edge being positioned in facing alignment to form an opening for receiving said screw drive when said first and second sections are connected together around said screw drive.

4. The collar attachment of claim 1 wherein said fastening means includes a bolt, one of said first and second sections having a through bore extending laterally through said last mentioned section, and said other of said first and second sections having a threaded bore extending laterally into said last mentioned section, said bolt extending through bores and turned into said threaded bore to secure said first and second sections to said screw drive.

* * * * *